United States Patent [19]

McCreary, Jr.

[11] Patent Number: 4,939,855

[45] Date of Patent: Jul. 10, 1990

[54] EXCAVATOR DIPPER WITH LIGHTWEIGHT REPLACEABLE SECTION

[75] Inventor: Robert A. McCreary, Jr., Gillette, Wyo.

[73] Assignee: Atlantic Richfield Company, Los Angeles, Calif.

[21] Appl. No.: 393,603

[22] Filed: Aug. 14, 1989

[51] Int. Cl.[5] ..... E02F 3/30; E02F 3/407

[52] U.S. Cl. ..... 37/103; 37/118 A; 37/141 R; 37/DIG. 12; 37/195; 414/722; 414/725; 414/726

[58] Field of Search ..... 37/103, 117.5, 118 R, 37/118 A, 141 R, DIG. 2, DIG. 12, 195; 414/722, 725, 726

[56] References Cited

U.S. PATENT DOCUMENTS

| | | | |
|---|---|---|---|
| 1,813,110 | 7/1931 | Bauer | 37/118 R |
| 3,070,246 | 12/1962 | Johnson et al. | 37/117 S X |
| 3,307,277 | 3/1967 | Kondracki | 37/141 R |
| 3,341,041 | 9/1967 | Salna | 37/DIG. 2 X |
| 3,767,070 | 10/1973 | Arnold | 414/726 X |
| 3,773,196 | 11/1973 | Shepherd | 414/726 X |
| 3,854,608 | 12/1974 | Arnold | 37/117.5 X |
| 3,921,316 | 11/1975 | Moreau | 37/118 A |
| 4,081,919 | 4/1978 | Teach | 37/103 |
| 4,457,085 | 7/1984 | Arnold | 37/103 |
| 4,550,512 | 11/1985 | Felstet | 37/117.5 |
| 4,691,455 | 9/1987 | Newman | 37/103 |

*Primary Examiner*—Dennis L. Taylor
*Assistant Examiner*—J. Russell McBee
*Attorney, Agent, or Firm*—Michael E. Martin

[57] ABSTRACT

The payload capacity of an excavating dipper or bucket for a power shovel or dragline is increased by providing an upper bucket portion having support brackets and the strength to support the rated load of the dipper and a disposable lower portion having opposed sidewalls and a bottomwall of a material thickness less than the upper sidewalls and topwall. The lower sidewalls are secured to the upper sidewalls by interference fitted retaining pins disposed in machined bores formed in the upper sidewalls and the lower sidewalls, respectively. The upper sidewalls may be modified to provide spaced-apart plate members which define a slot for receiving the lower sidewall portions, respectively.

9 Claims, 4 Drawing Sheets

EXCAVATOR DIPPER WITH LIGHTWEIGHT REPLACEABLE SECTION

BACKGROUND OF THE INVENTION

1. Field of the Invention

The present invention pertains to an excavating bucket or dipper having a lightweight replaceable section comprising the lower sidewalls and bottom wall of the bucket and a lightweight reinforced dump door.

2. Background

Excavating devices such as a power shovel dippers and dragline buckets must have adequate strength to withstand the high forces exerted thereon during excavating and carrying functions as well as resisting abrasive wear by the material being excavated. However, the weight of material required to provide adequate strength and life in the dipper or bucket reduces the effective payload of excavating apparatus such as power shovels or draglines.

In the excavation and loading of most materials, the payload per operating cycle and the number of operating cycles per unit time is of economic importance. If, for example, the payload per operating cycle of load-dump-prepare to load is increased, the operating cycle time can be reduced or the effective production of the shovel or dragline per unit time may be increased. This increased production in some applications of excavating machines such as the high volume production of coal and various minerals may easily offset the cost of more frequent replacing of the bucket or at least portions thereof. In this regard, the present invention is directed to providing a lightweight high-capacity excavating bucket or dipper having a replaceable section which may be easily replaced in the field and may yield a net increase in economic benefits. That is, the added production of the material excavated over a given amount of time may provide more revenue than the cost of replacing the replaceable section of the bucket.

Prior art excavating bucket and dipper designs have evolved as heavy, cast and welded structures or somewhat built-up structures of plate and welded reinforcements. In both instances, the entire bucket or dipper structure must be replaced when worn. Although the lower and sidewall portions of an excavating bucket are subject to the most wear and tear, these portions are not easily replaced or reconditioned in prior art excavating buckets. In this regard the present invention provides an improved bucket or dipper design which provides for field replacement of a section of the bucket which is subject to the greatest amount of wear, thereby providing a so-called throw-away portion or section of the bucket or dipper and which is lightweight so as to increase the effective payload of the bucket and/or by providing the bucket as a somewhat larger capacity device for the given capacity rating of a shovel or dragline so that the net payload per operating cycle of the machine may be increased.

SUMMARY OF THE INVENTION

The present invention provides an improved excavating dipper or bucket for use with an excavating machine such as a power shovel or dragline and wherein a lightweight replaceable section of the bucket is provided to reduce the overall weight of the bucket and increase the effective payload of the machine using the bucket.

In accordance with an important aspect of the present invention, an excavating dipper or bucket is provided having a replaceable portion which is of relatively lightweight construction as compared with prior dippers or buckets and includes relatively lightweight sidewalls and bottomwalls which are formed as an integral unit and are attachable and detachable from an integral upper sidewall and topwall portion of the bucket.

In accordance with another aspect of the present invention, there is provided an excavating dipper having a moveable backwall or dump door which is of lightweight construction and is provided with unique reinforcing gussets or ribs.

In accordance with yet another aspect of the present invention there is provided a field-replaceable section of an excavating dipper wherein a plurality of alignment and support pins are provided for connecting the upper section of the dipper, which is provided with the connecting structure for connecting the dipper to the shovel stick or boom, to a lower portion comprising the replaceable section. The integral lower sidewall and bottomwall section of the bucket is connected to the upper section by a series of force fitted pins which interconnect the sidewall plates of the replaceable section with the top sides of the upper section of the dipper.

Those skilled in the art will recognize the above-described features and advantages of the present invention together with other superior aspects thereof upon reading the detailed description which follows in conjunction with the drawing.

DESCRIPTION OF A PREFERRED EMBODIMENT

Figure 1:
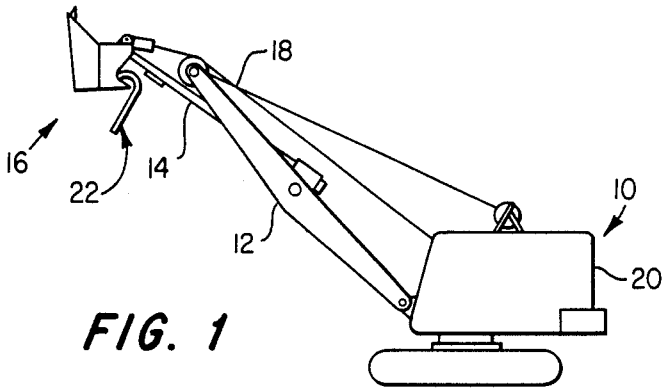
FIG. 1 is a side elevation of an excavating power shovel including the improved dipper of the present invention.

In the description which follows, like parts are marked throughout the specification and drawing with the same reference numerals, respectively. The terms "dipper" and "bucket" are both terms of the art, the former being used normally when referring to power shovels and hoes, and the latter when referring to draglines, and are intended to be used interchangeably herein.

Referring to FIG. 1, there is illustrated a power shovel, generally designated by the numeral 10 having a conventional boom 12 on which is mounted a dipper stick 14. The distal end of the dipper stick supports a dipper 16. A dipper stick hoisting cable arrangement 18 is controlled from a cab 20 for raising and lowering the dipper stick 14 to load and dump material with respect to the dipper 16. The exemplary dipper 16 is provided with a pivotable dump door 22 disposed thereon and adapted to be suitably controlled from the cab 20 in a conventional manner.

Large power shovels, such as the exemplary shovel 10, are typically rated in terms of a maximum suspended load which includes the weight of the dipper 16 and the payload contained therein. In many operations, such as in high production surface coal mines, the rate of production is measured in the number of passes or cycles required to load a haulage truck. Clearly, if the number of passes can be reduced by increasing the effective payload of the dipper without increasing the suspended load above the shovel rating, the rate of production of the mine may be increased. As little as a 10% increase in the effective payload of a dipper may reduce the number of passes required to load a haulage truck. However, the useful life of the dipper and the strength required to handle the payload must be taken into consideration. The present invention provides for an improved shovel dipper which may be modified from an existing heavily constructed dipper to have a throw-away or disposable section of the dipper which has a shorter life but which retains the strength required at the critical points of stress. This disposable or throw-away section of the dipper is considered to have an adequate life such that when replaced, the total cost of operation of the shovel is not increased with respect to its net payload output or production.

Figure 2:
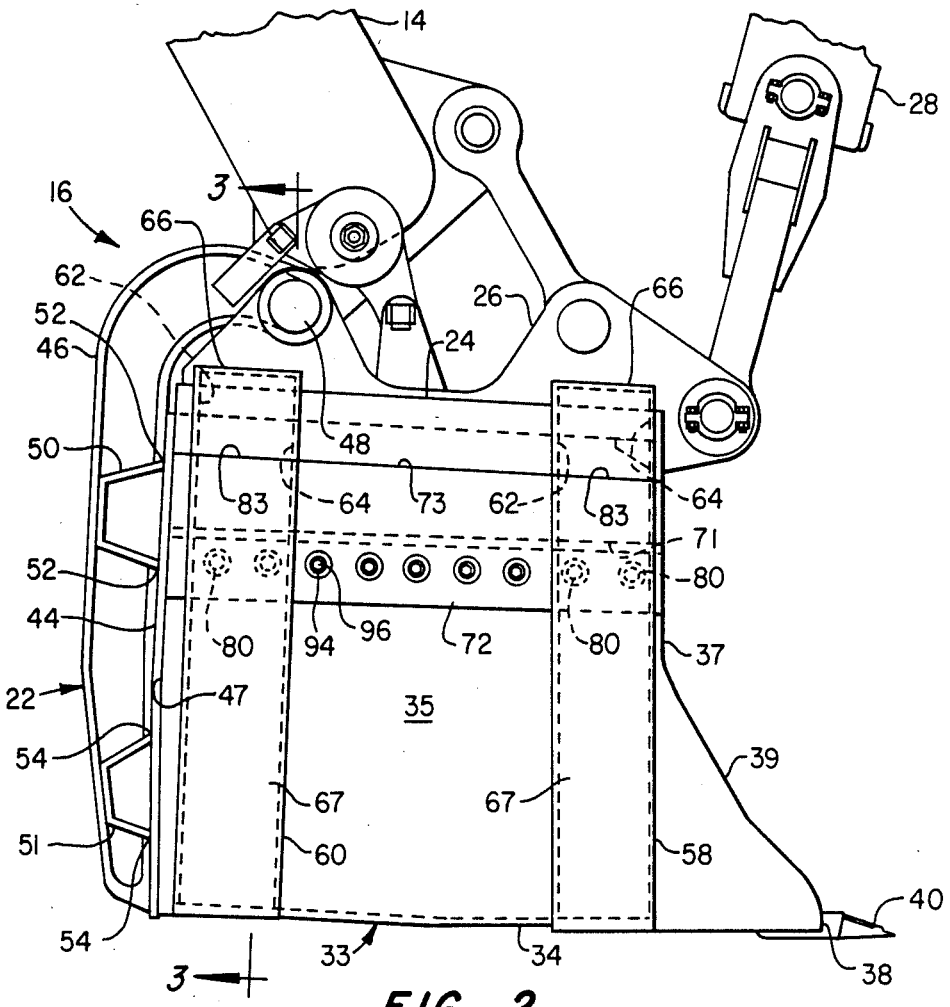
FIG. 2 is a side elevation on a larger scale showing certain details of the dipper shown in FIG. 1.
Figure 3:
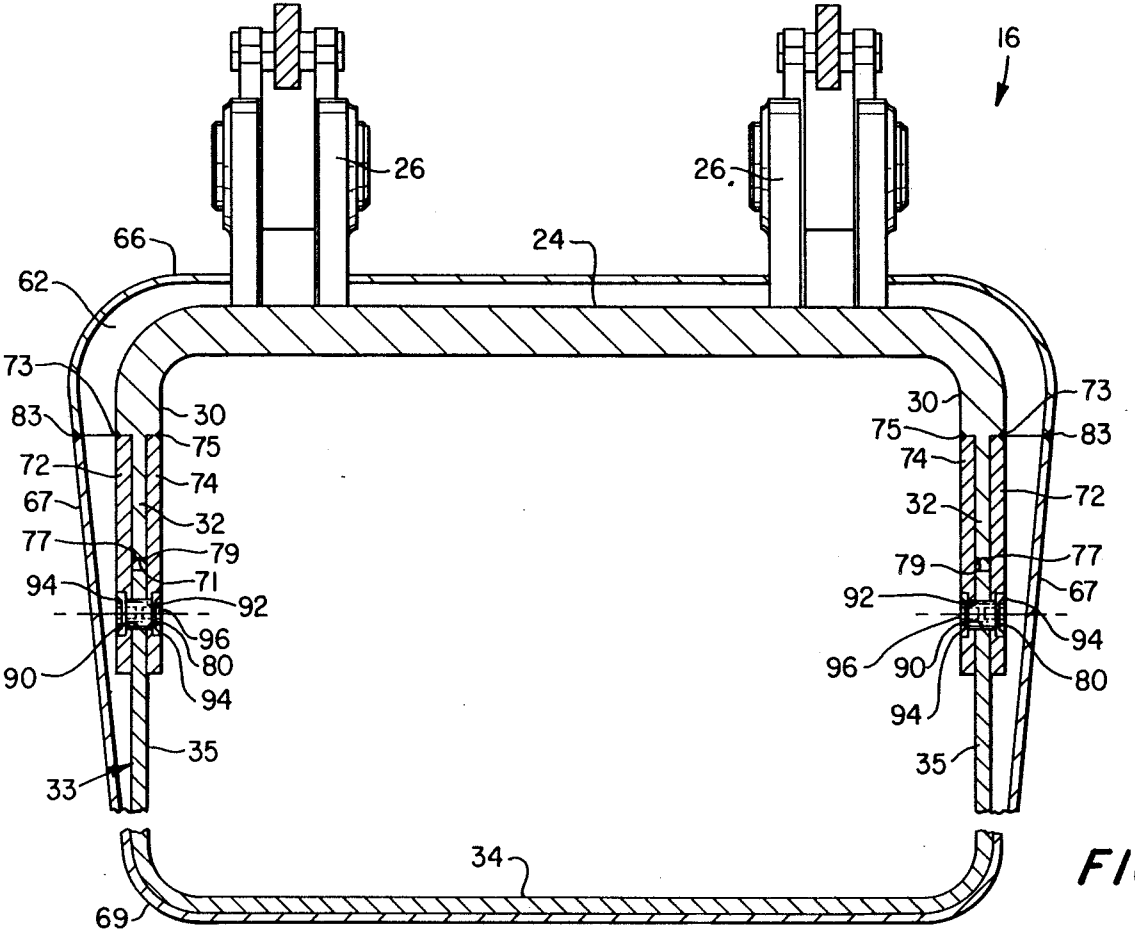
FIG. 3 is a section view taken generally along the line 3—3 of FIG. 2.

Referring now to FIGS. 2 and 3, in particular, there is illustrated the dipper 16 of a type which has been converted from an existing heavily constructed dipper. The dipper 16 includes a topwall 24 on which are mounted spaced apart brackets 26 adapted for connecting the dipper 16 to the dipper stick 14 and to suitable mechanism including a sheave 28, FIG. 2, over which the cable arrangement 18 is trained for lifting and lowering the dipper during the digging, travelling and dumping cycle of the shovel. The topwall 24 is typically formed of a heavy cast or rolled steel and may be integrally formed with depending sidewalls 30, FIG. 3. In accordance with the present invention, the depending sidewalls 30 have been modified to be reduced in thickness along a depending section 32. Alternatively, the topwall portion 24 and depending sidewall portions 30 could be initially formed to have the configuration illustrated in FIG. 3. In conventional shovel dipper and dragline bucket designs the cross sectional thickness of the topwall 24 may be carried into the sidewall portions and a bottomwall also. This massive, heavyweight construction is conducive to long life but, with conventional designs, effectively reduces the payload capacity of the bucket.

In the modified dipper 16 a replaceable dipper section 33 is formed to have a bottom wall 34 and opposed sidewalls 35 integral with the bottomwall, extending coplanar with the sidewalls 32, respectively, and typically of the same cross sectional thickness. As shown in FIG. 2, the bottomwall 34 extends beyond the front edge 37 of the sidewalls 35 and terminates in a cutting edge 38 on which may be mounted a plurality of cutting teeth 40 which may be permanently affixed to the front edge 38 or disposed in suitable sockets for replacement when worn. The front edge 37 of each sidewall 35 may slope toward the front cutting edge 38 along a cutting edge portion 39 also in a conventional manner.

Figure 4:
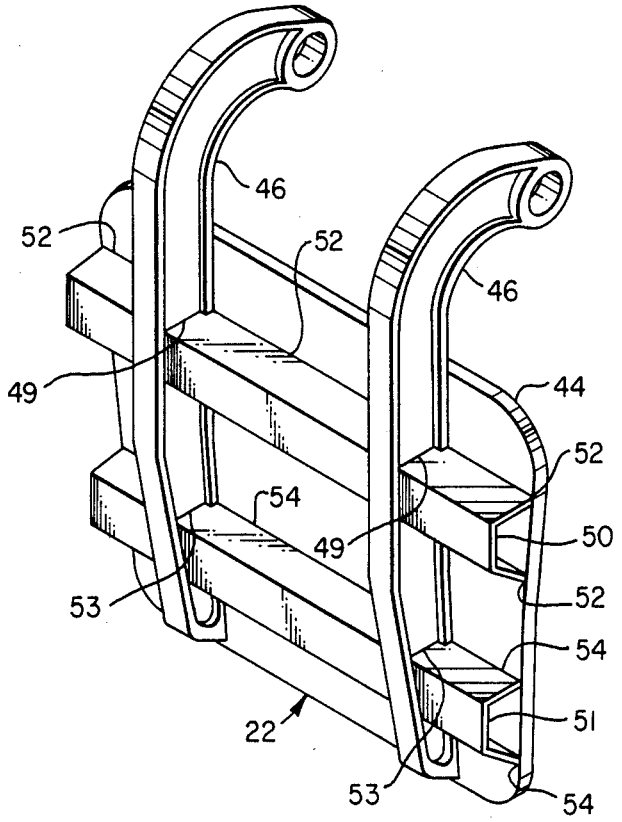
FIG. 4 is a perspective view showing a modified dump door for the bucket of the present invention.

Referring again to FIG. 2 and also FIG. 4, the dump door 22 is characterized by a door panel 44 which is supported on spaced-apart brackets 46 pivotally connected to the brackets 26 at pivot pins 48. A suitable latching mechanism, not shown, is operable to hold the door 22 in a closed position with the door panel 44 essentially contiguous with a substantially vertical rear side edge 47 of the respective sidewalls 35. The door 22 is particularly advantageously formed to be of relatively lightweight construction as regards the thickness of the panel 44 which is reinforced by two spaced-apart hollow channel-like braces 50 and 51, see FIG. 4, which are welded to the panel 44 along their longitudinal side edges at 52 and 54 as shown. In particular, the door 22 may be modified from a much heavier constructed door by reducing the panel thickness 44 and adding the braces 50 and 51. The braces 50 and 51 are adapted to extend through suitable openings 49 and 53 which have been cut in the respective brackets 46. The braces 50 and 51 are welded along their contiguous edges to the brackets 46.

Referring again to FIGS. 2 and 3, the dipper 16, as originally constructed and by way of example, may include front and rear built-up ribs 58 and 60. In the arrangement of the dipper 16, the ribs 58 and 60 are each made up of spaced-apart flanges 62 and 64 and a connecting web 66. The flanges extend across the topwall 24 and down each of the sidewalls 32 and are tapered along the sidewalls down to a point where the web 66 becomes contiguous with the bottomwall 34 essentially at the juncture between the sidewalls 35 and the bottomwall, as shown by example in FIG. 3 for the rib 60. The web 66 includes a sidewall portion 67 and a portion extending along the bottomwall 34 and designated by the numeral 69 which becomes the rib itself at this point. Those skilled in the art will recognize that the rib structure represented by the flanges 62 and 64 and the web 66 may take various forms of construction. In fact, the support rib may comprise only a thick plate similar to the web portion 66 which extends along the sidewalls 32, 35 and the bottomwall 34, or along a portion of the topwall 24 and the sidewalls.

Referring further to FIG. 3, in accordance with one aspect of the present invention it is contemplated that an existing integrally-formed shovel dipper having a continuous or integrally-formed topwall, sidewall and bottomwall structure may be modified by cutting away the lower sidewalls and bottomwall portion and modifying the upper sidewalls to form the reduced thickness portions 32. These sidewall portions 32 are then reinforced by opposed sidewall plates 72 and 74 which depend beyond a parting line 71 which forms the point of separation of the lower portion of the bucket or dipper from the upper portion including the topwall 24 and the support brackets 26. The depending sidewall portions 72 and 74 are then, after suitable modification of the upper sidewalls to provide the reduced thickness portions 32, secured to the sidewall portions 32 by welding along contiguous edges 73, 75, 77 and 79, for example.

Figure 5:
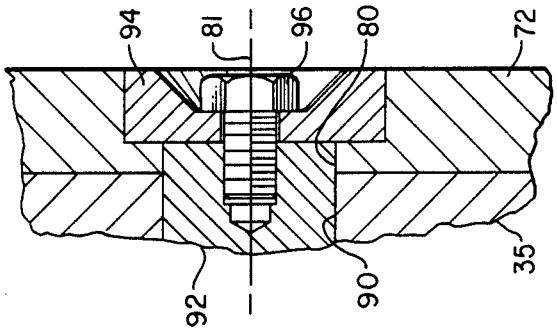
FIG. 5 is a detail section view of one of the pin connections.

The sidewall members 72 and 74 are also formed with cylindrical counter-bores 80, see FIG. 5, which are aligned with each other along a common axis 81. To this aforedescribed structure is added the disposable dipper section 33 which comprises the dipper bottomwall 34 and upwardly extending sidewall portions 35. The sidewall portions 35 are of a thickness only slightly less than the space between the depending sidewall portions 72 and 74 so that the upper distal ends of the sidewall portions 35 may be inserted in the space between the sidewall portions 72 and 74. The sidewall portions 35 are also provided with plural spaced-apart cylindrical bores 90 which are alignable with the bores 80, respectively, and for each receiving a retaining pin 92. A series of aligned bores 80 and 90 are formed in the upper and lower dipper sections, respectively. The pins 92 are dimensioned to be an interference fit in the bores 80 and 90 but are also retained therein by suitable, generally circular retainer members 94, see FIG. 5 also, which are countersunk to receive hex-head bolts 96 threaded into opposite ends of the pins 92 to retain the pins in assembly with the depending side wall portions 72 and 74 and the side wall portions 35, respectively.

The modified shovel dipper 16 as illustrated and described above provides for a so-called disposable or throw-away section which may be made of lighter-weight material than the upper portion represented substantially by the topwall 24 and the depending upper sidewalls 30. This type of dipper may be constructed originally as shown or field modified by removing the lower sidewalls and bottomwall portions of an existing dipper at the parting line 71. For example, an existing dipper 16 having sidewalls 30 of substantially constant thickness may be modified by cutting away the lower portion of the dipper at the parting line 71, reducing the thickness of the sidewalls to form the portions 32 and modifying the upper sidewall by the addition of the spaced apart sidewall portions 72 and 74. The disposable section 33 of the dipper 16 may, of course, be fabricated in suitable numbers to be available for immediate replacement should one fail from repeated use or otherwise be damaged.

If the dipper 16 is formed from field modification, a conventional dipper is cut along the parting line 71 and either formed to have the reduced thickness upper sidewall portion 32 or the upper sidewall portions similar to the sidewall portions 72 and 74 are merely welded to the opposite sides of the sidewall portions 30. The bores 80 may be preformed and aligned at assembly of the sidewall portions 72 and 74 or formed after the sidewall portions 72 and 74 are added to the upper portion of the dipper. By suitable alignment of the disposable dipper section 33, by aligning its bores 90 with the bores 80 and inserting the retaining pins 92, the disposable section is added to and made a part of the modified dipper 16. By way of example, the wall thickness of the lower section of the dipper as defined by the opposed sidewall portions 35 and the bottomwall portion 34 may be of a thickness as little as one-half to one-third of the thickness of the topwall portion 24.

After insertion of the pins 92 in the respective sets of bores 80 and 90, the retainers 94 are secured to the pins by the fasteners 96. If the support ribs 58 and 60 are provided with web portions 67, these rib portions are, of course, removed at the time of disassembly or modification of the dipper 16 and replaced after the new or replacement dipper section 33 is assembled. The webs 67 may be welded along their contiguous edges with the flanges 62 and 64 and also secured to the web 66 at the weld line 83. The lower dipper section 33 may be formed of high-strength steel plate selected for abrasion resistance.

Figure 6:
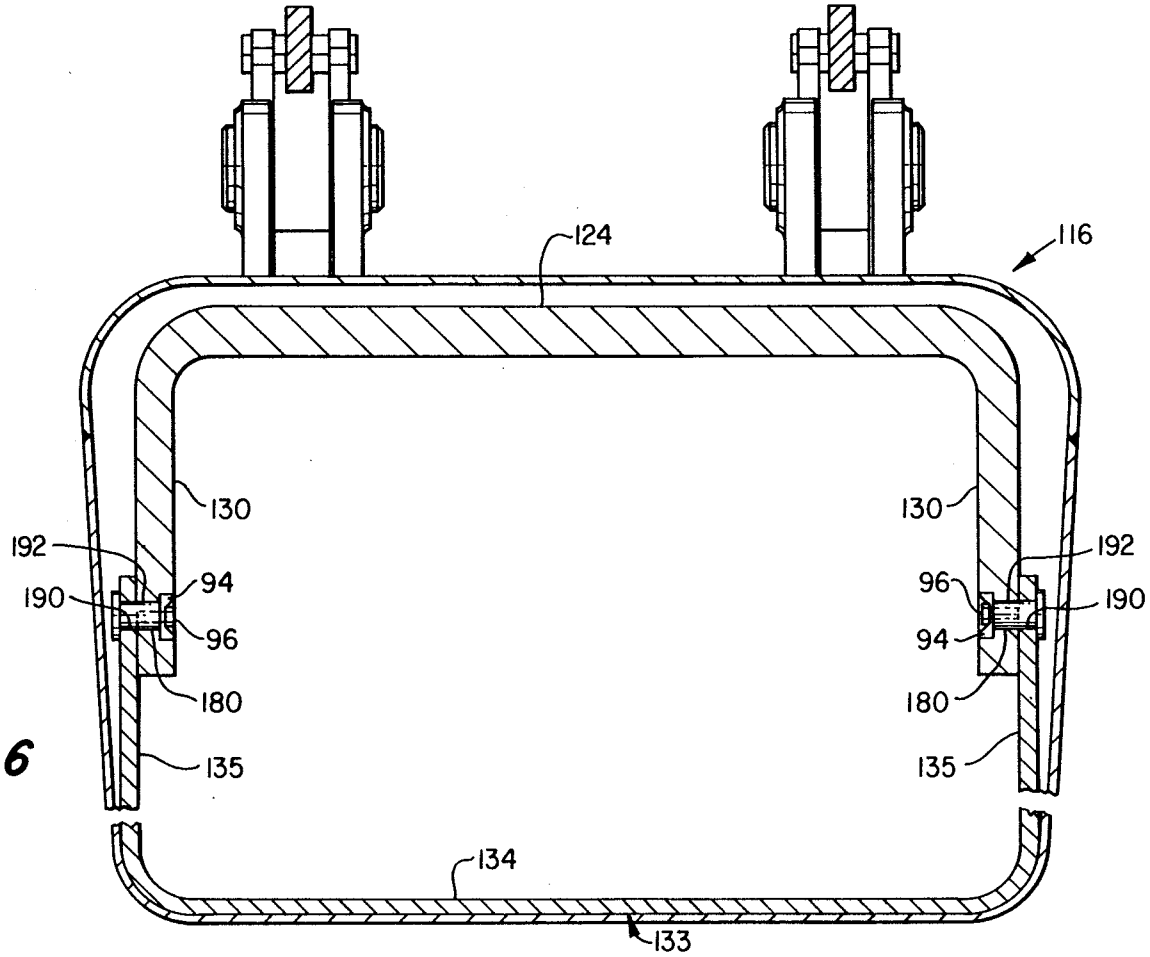
FIG. 6 is a section view similar to FIG. 2 of an alternate embodiment of the present invention.

Referring now to FIG. 6 there is illustrated a modification of the dipper 16, generally designated by the numeral 116. The dipper 116 has a topwall portion 124 and depending sidewall portions 130 which are of a predetermined thickness and are substantially integrally formed or integrally joined to each other. The dipper 116 includes a plurality of spaced-apart precision machined bores 180 formed in the sidewall portions 130 and adapted to receive retaining pins 192 for joining a modified lower bucket section 133 to the upper bucket portion. The lower bucket section 133 is provided with spaced-apart reduced-thickness sidewalls 135 and a bottomwall 134. The sidewall portions 135 are also provided with precision machined bores 190 which are adapted to be in registration with the bores 180 for receiving plural retaining pins 92. As shown in FIG. 6, the sidewall portions 130 are counterbored for receiving retainers 94 which are secured to the pins 92 by fasteners 96. Plural rows of bores 180 and 190 may be formed in the respective wall portions 130 and 135 to provide a more rigid connection between the disposable dipper section 133 and the upper bucket portion. The modification illustrated in FIG. 6 minimizes the amount of modification of the existing heavily constructed dipper by not requiring the formation of the reduced-thickness sidewall portions 32. Otherwise, the modification or initial fabrication of the dipper 116 is substantially similar to the dipper 16.

Although preferred embodiments of the present invention have been described in some detail herein, those skilled in the art will recognize that various substitutions and modifications may be made to the embodiments described without departing from the scope and spirit of the invention as recited in the appended claims.

What is claimed is:

1. A method of modifying a material excavating dipper to increase the material-handling capacity of the dipper for a given load handling capacity of an excavating machine, said method comprising the steps of: 'providing an excavating dipper having a topwall, opposed depending upper sidewall portions, lower sidewall portions integral with said upper sidewall portions and a bottomwall portion, all of a predetermined thickness;

separating said lower sidewall portions and said bottomwall portion from said topwall and said upper sidewall portions along a predetermined parting line;

providing a disposable dipper section comprising opposed lower sidewalls and a bottomwall and wherein at least one of said lower sidewalls and said bottomwall are of a thickness less than the thickness of at least one of said upper sidewall portions and said topwall;

providing fastening means for securing said upper sidewall portions to said lower sidewalls; and securing said disposable dipper section to said upper sidewalls to form a dipper having an increased payload capacity.

2. The method as set forth in claim 1 including the steps of:

forming a plurality of cylindrical bores in said upper sidewall portions and said lower sidewalls; and securing said upper sidewall portions to said lower sidewalls by said fastening means and wherein said fastening means comprises retaining pins having an interference fit in said bores, respectively.

3. The method set forth in claim 2 wherein:

at least part of said upper sidewall portions are formed by depending spaced-apart sidewall members which form a slot for receiving said lower sidewalls; and said method includes the step of inserting said sidewalls in said slot prior to securing said upper sidewall portions to said lower sidewalls, respectively.

4. An excavating dipper for use with an earth excavating machine and having an enhanced payload capacity, said dipper comprising:

a topwall including bracket means for connecting said dipper to said excavating machine;

opposed upper sidewalls spaced apart from each other and connected to and depending from said topwall;

a lower section of said dipper including lower sidewall members and a bottomwall, at least said lower sidewall members being of a thickness less than said upper sidewalls and removably securable to said upper sidewalls by removable fastener means for disposing of said lower dipper section when it is worn or damaged without replacing said topwall and said upper sidewalls; and support rib means on said upper sidewalls and said lower sidewall members, respectively, and secured to each other to strengthen said dipper.

5. The dipper set forth in claim 4 wherein:

said upper sidewalls are formed with a series of cylindrical bores, said lower sidewall members are formed with a corresponding series of cylindrical bores and said fastener means comprise retaining pins disposable in and secured in said said bores for connecting said lower section to said dipper.

6. The dipper set forth in claim 5 wherein:

said retaining pins are in interference fit in said bores.

7. The dipper set forth in claim 6 wherein:

said pins are retained in said bores by opposed retainer means and removable fastener means for securing said retainer means to at least one end of said pins, respectively.

8. The dipper set forth in claim 4 wherein:

said upper sidewalls are each formed by a reduced-thickness portion integral with said topwall and opposed upper sidewall members secured to said reduced-thickness portion and depending therefrom to form a slot for receiving said lower sidewall members, respectively.

9. A method of modifying a material excavating dipper to increase the material-handling capacity of the dipper for a given load handling capacity of an excavating machine, said method comprising the steps of:

providing an excavating dipper having a topwall, opposed depending upper sidewall portions, lower sidewall portions, and a bottomwall portion, all of a predetermined thickness and support rib means on said upper sidewall portions;

separating said lower sidewall portions and said bottomwall portion from said topwall and said upper sidewall portions along a predetermined parting line;

providing a disposable dipper section comprising opposed lower sidewalls, a bottomwall and support rib means on said lower sidewalls and wherein at least one of said lower sidewalls and said bottomwall are of a thickness less than the thickness of at least one of said upper sidewall portions and said topwall;

providing fastening means for securing said upper sidewall portions to said lower sidewalls;

securing said disposable dipper sections to said upper sidewalls with said fastening means; and securing said support rib means on said lower sidewalls to corresponding support rib means on said upper sidewall portions, respectively, to form a dipper having an increased payload capacity.

* * * * *